United States Patent [19]

Schwabe et al.

[11] 3,986,190

[45] Oct. 12, 1976

[54] SYSTEM FOR GENERATING MAGNETIC IMAGES

[76] Inventors: Eberhard A. Schwabe, Bergstr. 34, 5202 Hennef, Sieg 1, Germany; Donald M. Came, 27 Stanton Road, Brookline, Mass. 02146

[22] Filed: Apr. 2, 1975

[21] Appl. No.: 564,372

Related U.S. Application Data

[63] Continuation-in-part of Ser. No. 456,790, April 1, 1974, abandoned, which is a continuation of Ser. No. 195,323, Nov. 3, 1971, abandoned.

[52] U.S. Cl. ..... 346/74.1; 340/174 TA

[51] Int. Cl.[2] ..... G03G 19/00

[58] Field of Search ..... 360/119, 123; 340/174 PM, 174 TF, 174 AG, 174 TA; 346/74.1

[56] References Cited

UNITED STATES PATENTS

| | | | |
|---|---|---|---|
| 2,736,880 | 2/1956 | Forrester | 340/174 TF |
| 3,023,402 | 2/1962 | Bittmann | 340/174 TF |
| 3,030,612 | 4/1962 | Rubens | 340/174 TF |
| 3,058,100 | 10/1962 | Hagopian | 360/123 |
| 3,084,336 | 4/1963 | Clemons | 340/174 TF |
| 3,161,544 | 12/1964 | Berry | 346/74.1 |
| 3,185,777 | 5/1965 | Rheinfrank | 346/74.1 |
| 3,456,250 | 7/1969 | Barcaro | 360/123 |
| 3,662,361 | 5/1972 | Mee | 360/123 |

*Primary Examiner*—Jay P. Lucas
*Attorney, Agent, or Firm*—Cesari and McKenna

[57] ABSTRACT

A system for generating magnetic images has a recording head positioned opposite the surface of a recording member such as a magnetic tape or drum. The head carries at least two layers of separate meandering electrical conductors. The conductors in each layer are arranged so that segments thereof overlap at a multiplicity of discrete points on the head with each such point being defined by a selected pair of conductors, one from each layer. When current is applied to a selected conductor pair, a magnetic field is generated at the corresponding point on the head which is strong enough to magnetize the area of the recording medium opposite that point. Thus, when selected conductor pairs in the head are energized in accordance with an input pattern using suitable addressing techniques, a corresponding latent pattern is magnetically impressed on the recording medium. Then a suitable magnetic ink or toner is applied to the recording medium, reducing the latent image to a visible form suitable for transfer to paper or the like.

13 Claims, 7 Drawing Figures

SYSTEM FOR GENERATING MAGNETIC IMAGES

RELATED APPLICATIONS

This application is a continuation-in-part of application Ser. No. 456,790, filed Apr. 1, 1974, which is, in turn, a continuation of application Ser. No. 195,323, filed Nov. 3, 1971, both entitled SYSTEM FOR GENERATING MAGNETIC IMAGES, and both of which are now abandoned.

BACKGROUND OF THE INVENTION

This invention relates to a system for generating images magnetically. It relates more particularly to magnetic printing apparatus for making single and multiple copies of characters, graphics and the like.

In some proposed magnetic printing systems, a magnetic toner of ink is deposited on a suitably magnetized recording medium such as a tape or a drum to form a visible pattern. The magnetic material is then transferred by means of pressure and adhesion to paper stock. The ink or the paper stock may contain a wax or a thermoplastic binder which is liquified temporarily during or after the transfer and which thereafter provides a permanent bond between the ink and paper stock. Thus, using this technique, one can make reproductions of both text and pictorial subject matter.

Conventionally, the recording medium is selectively magnetized by a magnetic recording head. One proposed system of which we are aware employs a single pole recording head which scans across the recording drum line-by-line in the manner of a typewriter. During each scan line, the pole is energized in accordance with an input pattern to form a corresponding latent magnetic image on the drum. That system has the disadvantage of being quite slow. Other prior systems employ a recording head having a number of poles spaced along its length and covering the width of the magnetic drum. The head and drum are moved incrementally relative to one another and after each such movement, selected areas of the poles in the head are energized in turn to produce a linear pattern of magnetic dots on the drum. In other words, those systems scan each line electronically and advance from line to line mechanically.

Systems using multipole recording heads of the above type are potentially faster than those using single pole heads. However, they are not able to produce high quality reproductions. This is because the pole elements in the head are unavoidably large and, hence, the magnetized dot areas which they impress on the recording medium to form a pattern are spaced relatively far apart. Therefore, the reproductions of the pattern on the medium have relatively poor definition.

In addition, a practical system must be able to reproduce relatively wide patterns and long lines of text. This means that a very large number of independently switchable pole elements are required in the recording head in order to cover a complete line of text and these elements, including the required number of electronic switches, make the prior units quite complex and expensive to manufacture. Further, they still do not operate at a fast enough rate to meet many present-day requirements.

Accordingly, it is the object of the present invention to provide a system for generating magnetic images very quickly.

Another object of the invention is to provide a magnetic printing system whose reproductions are of a uniformly high quality.

A further object of the invention is to provide a magnetic printing system which operates at ultrahigh speeds Yet another object of the invention is to provide a magnetographic printing system having a multipole printing head whose magnetically active centers are very closely spaced, on the order of 0.01 inch.

A further object of the invention is to provide a magnetographic printing system which is relatively easy and inexpensive to make.

Other objects of the invention will in part be obvious and will in part appear hereinafter.

The invention accordingly comprises the features of construction, combination of elements and arrangement of parts which will be exemplified in the construction hereinafter set forth and the scope of the invention will be indicated in the claims.

Briefly, the present system impresses a latent image magnetically on a recording member such as a tape or drum using a special multipole recording head to be described presently. Then a magnetic ink or toner is applied to the drum. The toner adheres only to those portions corresponding to the dark parts of the latent image thereby reducing that image to a visible form. The magnetic toner is then transferred in the usual way by means or pressure and adhesion to paper brought into contact with the drum.

The printing head is composed of at least two layers of meandering electrical conductors, there being a number of separate conductors in each layer. These conductors are arranged so that selected segments of conductors in one layer are positioned above selected segments of conductors in the other layer at closely spaced points along the recording head. These points form the magnetically active centers of the head. In other words, each of these centers is defined by a selected pair of conductors, one from each layer.

At each of these centers, the corresponding segments of a conductor pair are arranged so that when electric currents are applied simultaneously to the conductor pair, two coinciding magnetic fields are generated which together are strong enough to change the magnetization of a corresponding point on the surface of the recording medium opposite the particular active center of the head. However, the recording medium has sufficiently high coercivity that its magnetization is not changed by only one field generated by the current flow in only one of the conductors of the pair. In other words, the magnetization of the recording medium is changed only at those centers of the head where there are coincident fields.

Using this coincident field addressing technique, selected pairs of conductors are energized in a timed manner so as to sweep out on the recording medium a latent magnetic image comprised of appropriately placed, closely spaced, magnetic dots. The medium is then dusted with a magnetic toner so that the latent image becomes visible. The toner may be transferred to a sheet of paper to make a hard copy of the image. Furthermore, since the recording medium retains the magnetic pattern impressed on it, after transfer of the magnetic toner, more toner can be applied repeatedly to the drum and transferred to successive sheets of paper to make multiple copies of the information on the recording medium.

The recording head in our system can have a single linear array of magnetically active centers extending across the recording member. In this event, the centers are activated electronically as the recording member advances so that the information is swept out line-by-line in the manner of a television raster without interlacing. Alternatively, the magnetically active centers may be arrayed in two dimensions in the head and be selectively energized in two dimensions, thus eliminating the need for any relative motion between the head and the recording member in order to record an image on the member.

The generation of coinciding magnetic fields to produce the magnetizing poles in the recording head, combined with matrix switching to activate the poles selectively, enables the present system to generate large, high-quality reproductions extremely rapidly. Yet the system is relatively inexpensive to make and easy to maintain.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
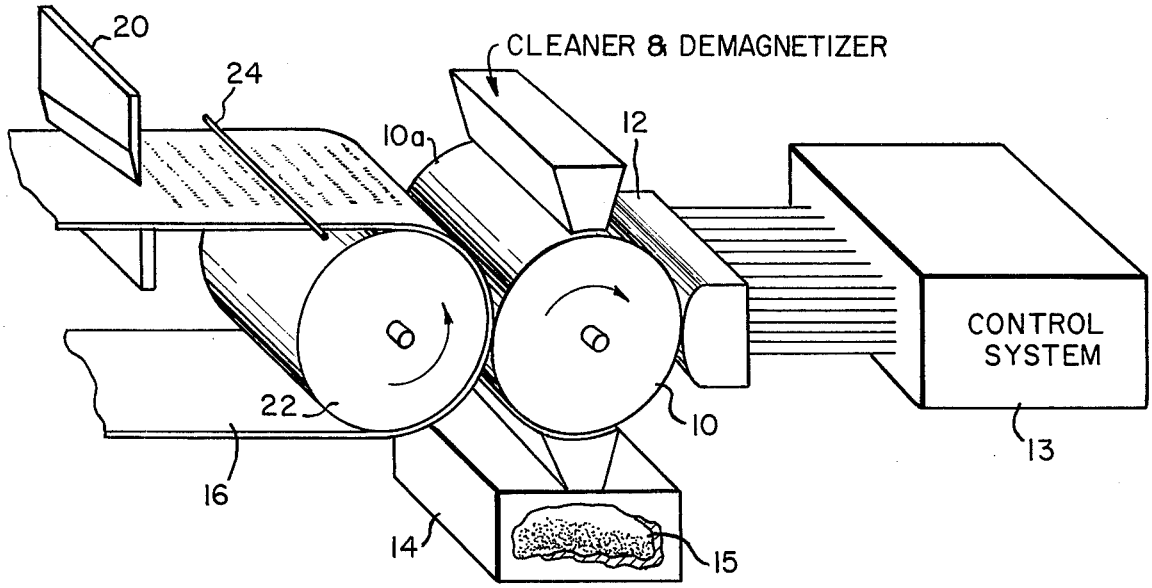
FIG. 1 is a diagrammatic view of a magnetic printing apparatus made in accordance with this invention.

Turning now to FIG. 1 of the drawings, the preferred embodiment of our system includes a rotatable magnetic recording member, to wit: a drum 10, and a multipole recording head 12 positioned opposite and close to the drum. Head 12 contains a single row of very closely spaced magnetically active centers. These are activated electronically by a control system 13 as the drum rotates to produce a latent magnetic image on the recording medium 10*a* on the drum. A magnetic toner 15 from a supply 14 is applied to the medium 10*a* on the drum and it adheres only to those spots thereon magnetized by head 12 so that the latent magnetic image becomes visible.

A supply of paper 16 is fed around a drum 22 so that it contacts the surface of drum 10. Whereupon, the magnetic toner is transferred by the pressure at the nip to the paper 16. The treated paper then passes under a heater 24 which fuses the toner onto the paper, thus creating a permanent reproduction of the information impressed magnetically on drum 10.

The drum 10 retains its latent magnetic image so that, if desired, it can be reinked to make multiple copies of the same information. In this event, a paper cutter 20 is arranged to cut the paper 16 between successive printed copies.

Figure 3:
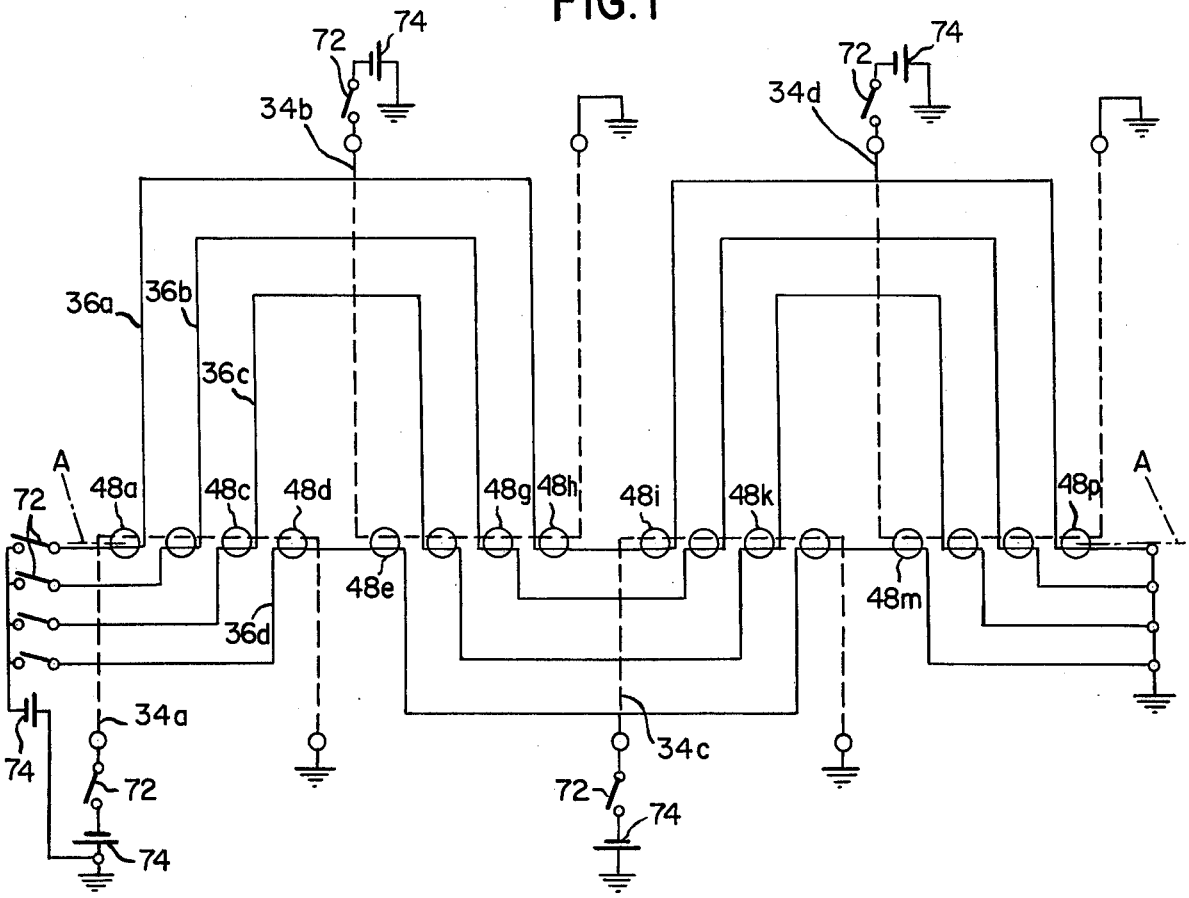
FIG. 3 is a schematic diagram showing parts of the FIG. 2 head.
Figure 2:
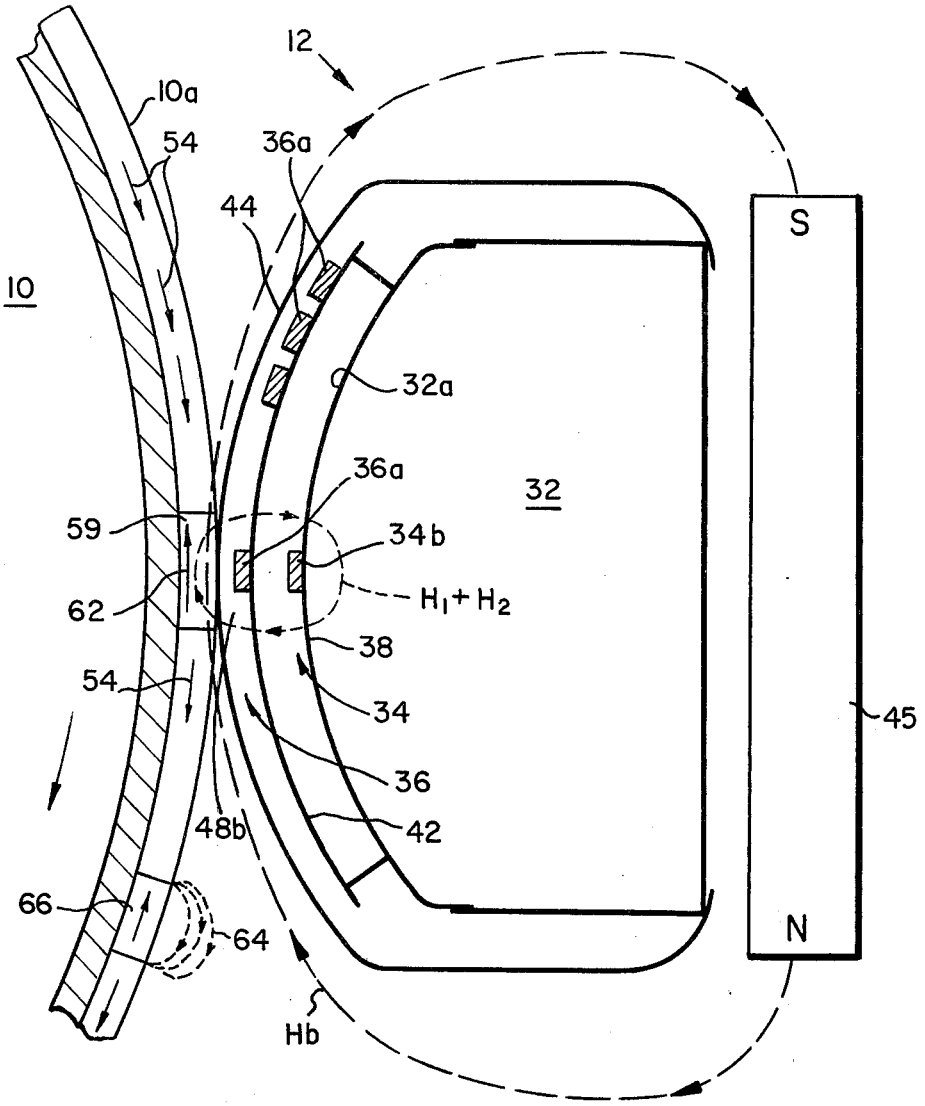
FIG. 2 is a diagrammatic view on a larger scale showing the recording head in the FIG. 1 apparatus in section.

Referring now to FIGS. 2 and 3, the magnetic recording head 12 is comprised of an elongate, generally rectangular, body 32 having a rounded leading face 32*a* opposite drum 10. Two electrical conductor layers shown generally at 34 and 36 conform to face 32*a*. The inner conductor layer 34 is held in position by a plastic substrate 38, while the outer layer 36 is affixed to a similar substrate 42 laminated to layer 34. A replaceable outer plastic skin 44 about 0.0005 inch thick covers the outer conductor layer 36 to protect the conductors from abrasion by the recording drum.

To simplify the discussion, a recording head of only 16 bits is treated. Also, for ease of illustration, the substrate and conductors are shown on a greatly enlarged scale. Also, the spacings between the various parts are greatly exaggerated. In actuality, the electrical conductors are on the order of 0.004 inch wide and 0.0007 inch thick and they are applied to substrates, composed of plastic film 0.0005 inch thick, using conventional photo-etching techniques. Thus, the conductors can be spaced very closely together.

A generally rectangular permanent magnet 45 is placed flush against the rear face of body 32 for reasons to be described later.

FIG. 3 shows the two conductor patterns in layers 34 and 36 laid flat, the former being shown in dotted lines, the latter in solid lines. Conductor pattern 34 is comprised of four separate conductors 34*a* –34*d*, each following a U-shaped path. These conductors are arranged so that their webs are aligned along an axis A with the legs of alternate conductors stretching out on opposite sides of that axis.

Conductor layer 36 also has four separate conductors 36*a*–36*d*. However, these conductors lie parallel to one another and follow a generally sinuous course disposed symmetrically about axis A. Short horizontal segments of conductors 36*a*–36*d* spaced along axis A are positioned above horizontal segments of conductors 34*a*–34*d* similarly located along axis A. These parallel segments are outlined by the circular areas 48 in FIG. 3. These circular areas 48 correspond to the magnetically active centers of the recording head 12 (FIG. 1). In the illustrated embodiment, there are sixteen such areas 48*a* to 48*p* spaced equally apart along axis A, which, incidentally, is perpendicular to the direction of motion of recording medium 10*a*.

For ease of illustration, we have indicated the conductor segments within areas 48 as being spaced closely together side-by-side. In actuality, however, these segments of conductors 34 are located directly below the corresponding segments of conductors 36. Also, while we have shown only sixteen such poles, it should be understood that a practical system for recording over a fourteen inch width may require 2000 or more such centers 48 spaced very closely together, e.g. 0.007 inch.

As best seen in FIG. 3, the conductors in layers 34 and 36 are arranged so that different pairs of conductors from each layer pass through the different centers 48*a* to 48*p*. In other words, each magnetically active center is determined by a selective pair of conductors, one from each layer. For example, center 48*a* is defined by conductors 36*a* and 34*a*, center 48*b* is defined by conductors 36*b* and 34*a*, center 48*h* is defined by conductors 36*a* and 34*b*. No pair of conductors defines more than one magnetically active center 48.

Whenever an electrical current (e.g. 3 amps) is passed through a conductor in layer 34, a first magnetic field is developed at the drum 10 surface 10*a*. Similarly, when a current (e.g. 2 amps) is passed through a conductor in layer 36, a second magnetic field is created at the drum surface. Now, when a given pair of conductors from layers 34 and 36 are so energized at the same time, the magnetic fields will coincide at the one center 48 defined by those two conductors producing a strong resultant field at the surface of the drum. Thus, by selectively energizing the conductors from each layer, a relatively strong magnetic field can be developed opposite any one magnetically active center 48*a* to 48*p*.

Figure 4:
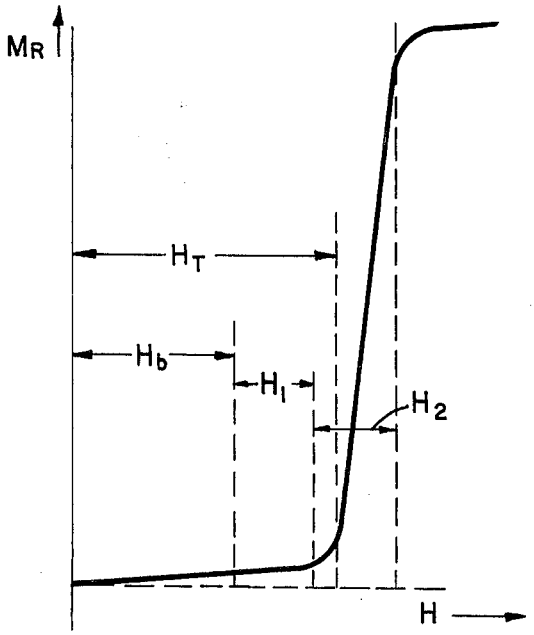
FIG. 4 is a graphical representation showing the desirable magnetic characteristics of the recording medium used in the FIG. 1 apparatus.

Turning now to FIG. 4, for best results, the recording medium 10*a* on drum 10 should have relatively high coercivity and a good square remanence curve. FIG. 4 shows this remanence curve of a suitable material. The threshold field of this material is indicated at $H_T$. Also shown are the magnetic fields $H_1$ and $H_2$ developed by currents flowing in conductors 34 and 36 in head 12 (FIG. 2).

In addition, a bias field $H_b$ is illustrated. This bias field is provided by the magnet 45 on the back of body 32 (FIG. 2). Magnet 45 is arranged to provide a widely spread bias field which is additive to the fields developed by the energized conductors at the various centers 48.

The bias field $H_b$ by itself is not strong enough to cause any substantial change in the magnetization of the recording medium 10*a*. Further, the fields $H_1$ and $H_2$ developed by the energized conductors are chosen in strength so that the sum of the bias field $H_b$ and either field $H_1$ or $H_2$ does not cause any substantial change of magnetization in the recording medium 10*a*. On the other hand, when the medium is subjected at the same time to all three fields, i.e. $H_b + H_1 + H_2$, a substantial change of magnetization of the medium occurs. Thus, the sum of the bias field $H_b$ and the coincident fields $H_1$ and $H_2$ produced at a selected center 48 in head 12 is sufficient to change the magnetization of the recording medium area directly opposite that center. By selectively energizing pairs of conductors from layers 34 and 36, then, selected magnetically active centers 48*a* to 48*p* can be activated to magnetize corresponding spots on drum 10 while the other centers are inactive.

For example, FIG. 2 shows the conductor 34 and 36 segments at center 48*h* in contact with the recording medium 10*a* on drum 10. For this example, we will assume that its recording medium 10*a* has been uniformly premagnetized in the direction of the arrows 54. Also, shown in the field $H_b$ due to magnet 45. As seen from FIG. 2, the field $H_b$ direction in pole area 48*h* is opposite to the direction of arrows 54.

Assume now that conductors 34*b* and 36*a* are energized. This produces coinciding magnetic fields $H_1$ and $H_2$ at center 48*h* as shown in dotted lines. The directions of these coinciding fields are also opposite to the direction of arrows 54. The sum of the three fields $H_b$, $H_1$ and $H_2$ suffices to reverse the direction of magnetization at the small spot 59 on the recording medium opposite center 48*h* as indicated by the arrow 62.

This change in magnetization of the recording medium in spot 59 produces stray fields at the boundaries of that spot. These stray fields extend out from the surface of the medium as indicated in FIG. 2 by dotted lines 64 at a similar spot 66 previously magnetized by head 12.

Turning again to FIG. 1, as drum 10 turns, the magnetized spots on the surface are brought opposite supply 14. Magnetic toner 15 from this supply is dusted over the surface of the drum and is attached by the stray fields 64. It adheres to the drum at the locations of those fields producing very small visible spots on the order of 0.005 inch in diameter.

The force of attraction of the fields 64 upon the toner particles is proportional to the magnetic permeability of the toner times the field strength at the location of the particles times the gradient of the field strength at that same location. Obviously, this force should be substantially more than the weight of the particles so as to assure their adhesion to the drum as it rotates and vibrates to some extent.

As a practical matter, the strength of field 64 and its gradient are proportional to the volume of, and the remanent magnetization of, the magnetized spot on the medium. For all practical purposes, this volume is determined by spot area since the localized fields needed for sufficient attraction of the toner particles will have sufficient strength only over a limited distance away from the volume elements of the magnetized spot. Actually, that distance is of the order of the spot size itself. The magnetized volume, then, is effectively determined by the surface dimension of the spot. That dimension is more or less determined by the center distance between adjacent spots, which, in turn, depends on the resolution capability of the human eye. Consequently, the only variable which appreciably influences the strength of adhesion of the toner particles to drum 10 is the specific remanent magnetization of the recording medium 10*a*. This is a primary reason why the selected medium should have a high saturation remanence.

Experiments have shown that a magnetic medium 10*a* composed of acicular gamma ferric oxide particles in a suitable binder are reasonably well-suited for high speed dot pattern generation. The thickness of the magnetic medium 10*a* made in this way is optimized at between 0.0005 inch and 0.003 inch. In an actual example, a medium 10*a* having a threshold field $H_T$ of 290 Oersteds yielded best results with a bias field $H_b$ of 225 Oersteds are coinciding fields $H_1$ and $H_2$ of 65 Oersteds each.

In a preferred embodiment of this system, the parallel conductor segments defining the active centers 48*a* to 48*p* are all aligned in the same direction, e.g. horizontally in FIG. 3. On the other hand, the conductor lengths on each side of the parallel segments are aligned perpendicular to those parallel segments, e.g. vertically in FIG. 3.

Also in this embodiment, the magnetic crystals comprising medium 10*a* are oriented so that their easy axes or directions of magnetization are aligned generally perpendicular to the parallel conductor segments in head 12.

The easy axis of magnetization is described at pages 113, 114 and 131 in the publication Physics of Magnetism by Soshin Chikazumi, published in 1964 by John Wiley & Sons, Inc. It is the direction along which magnetization takes place easily. For example, iron crystals have three easy axes of magnetization, namely, the [100], [010], and [001] crystal directions. Consequently, the internal magnetization of iron is stable when pointing parallel to one of these directions.

Single crystal particles of sub-micron size (in the order of 0.001 micron) have an anisotropy determined by their shape. For example, needle-shaped particles of iron or gamma ferric oxide have an uniaxial anisotropy with the preferred direction of magnetization along their needle axis. (See Magnetic Properties of Metals and Materials, American Society of Metals 1959, page 1537.) Such elongated single domain particles are well-suited for medium 10*a*.

The magnetic particles or crystals comprising medium 10*a* can be aligned using any of the available techniques. For example, they can be mixed into a binder to adhere them to drum 10 and be oriented prior to setting the binder. Alternatively, a well-oriented magnetic surface can be applied to the drum 10 directly by vacuum deposition as described, for example, in an article entitled "Oblique Incidence Evaporated Iron Film" in the March 1970 edition of the Journal of Applied Physics, Volume 41, page 1254.

This arrangement minimizes the current required in the head 12 conductors to switch the magnetic domains in medium 10*a*. It also minimizes unwanted domain switching in medium 10*a* due to stray magnetic fields around the conductor lengths outside the active centers 48*a* to 48*p*.

The coincident field technique described herein for activating the recording head poles simplifies the electronics required to impress information on drum 10. More particularly, in the system illustrated in FIG. 3, only eight (rather than sixteen) switches 72 are needed to connect the conductors selectively to a current source illustrated by battery 74 to choose any one of the sixteen pole areas on recording head 12. That is, there is one switch 72 for each of the conductors in FIG. 3. By closing simultaneously pairs of switches 72 controlling selected pairs of conductors 34 and 36 in a proper sequence, the magnetically active centers in recording head 12 may be "scanned" say from left to right. As scanning proceeds, the currents in conductors 34 and/or 36 may be modulated by known means in accordance with the intensity required for each particular dot, to sweep out a portion of the magnetic image on the drum. Then, as the drum advances relative to the head, other switches 72 are closed to activate different centers in the recording head so as to sweep out the next horizontal segment of the magnetic image, and so on. Thus, the system sweeps out the pattern in a manner very similar to a television raster with different centers in the head being energized by the control system 13 until the entire pattern is complete. It should be understood also that the generation of the magnetic image on the drum can be accomplished extremely quickly by using solid state switches. Furthermore, the resultant image has extremely good definition because the individual spot areas on the drum which are magnetized by the head are extremely small. Consequently, the resultant reproductions are of generally good quality.

We should mention at this point that in the system specifically illustrated in FIG. 3, there are only sixteen centers on head 12. Consequently, the savings in the switching requirements may not seem very significant. However, the advantages become readily apparent when one considers that a system employing a recording head with 2056 magnetically active centers made in accordance with our invention would require only 96 switches instead of the 2056 switches heretofore required to operate a multipole head of the same capacity. By known means of matrixing the switches, the number of switches can be further reduced to 28.

It should be appreciated also that the implementation of our coincident field method to magnetize a recording medium can be done in various ways, as long as there are at least two independently switchable field patterns which coincide to cause the activation of a given center in the recording head at a given time and, hence, the magnetization of a particular spot on the recording medium.

Also, it should be understood that more than two layers of conductors may be used in the same manner to effect a further reduction in the required switching capability of the system. For example, a multipole recording head having 2056 centers formed by three conductor pattern layers operating in coincidence and with matrixing in the foregoing way requires only 22 switches to activate any of the 2056 individual centers.

Figure 5:
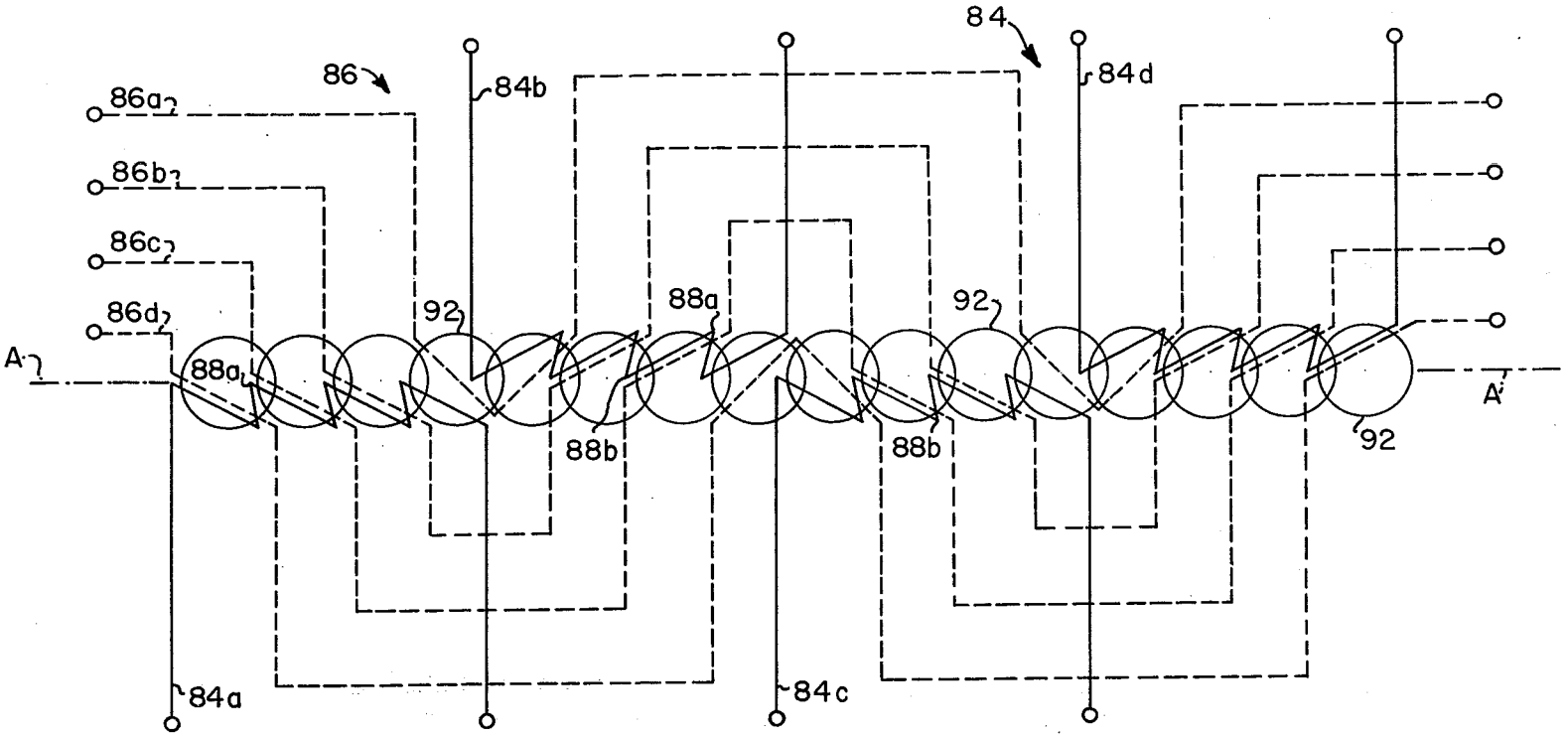
FIG. 5 is a diagram similar to FIG. 3 illustrating a modified recording head.

Referring now to FIG. 5, using our coincident field recording technique, one can also impress a negative magnetic image on a recording medium such as medium 10*a*. This embodiment is similar to the one shown in FIGS. 2 and 3, except that the conductor patterns in the head are somewhat different. Again, there are two conductor layers 84 and 86, the former being shown in solid lines, the latter in dotted lines. Layer 84 is comprised of four, generally V-shaped conductor patterns 84*a* to 84*d* whose webs are aligned on axis A and whose legs extend out on opposite sides of this axis. The webs of these conductors, unlike those illustrated in FIG. 3, zig-zag symmetrically about axis A. That is, each has three peaks 88*a* above axis A and three valleys 88*b* below that axis. Furthermore, the webs of alternate conductors 84*a* to 84*d* zig-zag in opposite directions. In other words, the peaks 88*a* of conductor 84*a* are skewed to the left, while those of conductor 84*b* are skewed to the right and so on.

Conductor layer 86 is also composed of four conductors 86*a* to 86*d*. These lie generally parallel to one another and are disposed in a generally sinuous pattern about axis A. As before, certain segments of conductor 86 are positioned above the corresponding segments of conductors 84. These segments are at precisely spaced locations along axis A. There are 16 such coinciding segments marked by the circular areas 92. These areas constitute the magnetically active centers of the recording head. As before, by selectively energizing different pairs of conductors 84 and 86, any one of the centers 92 can be activated. As seen from FIG. 4, the magnetically active centers 92 overlap along axis A for reasons to be discussed presently.

Figure 6:
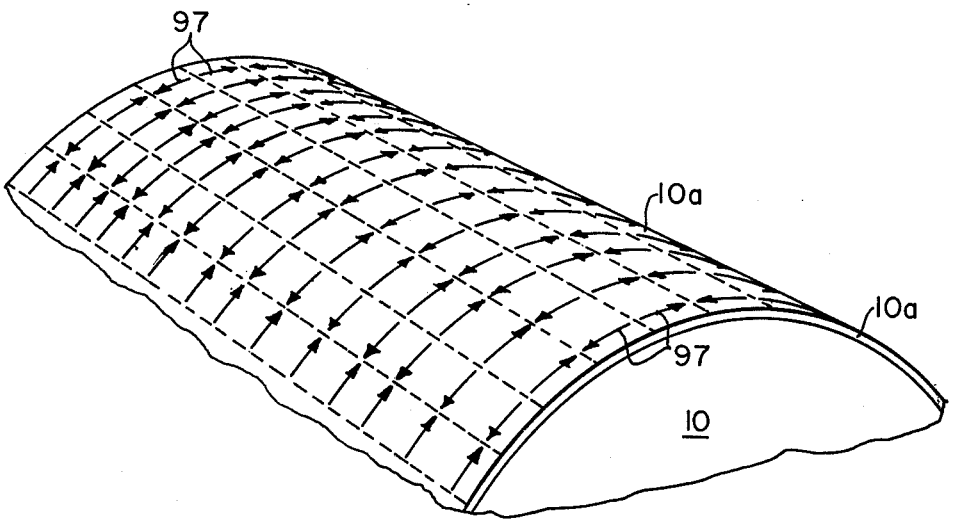
FIG. 6 is a diagrammatic view of a premagnetized recording medium used with the FIG. 5 head.

Turning to FIG. 6, for negative imaging, the recording medium 10*a* is first premagnetized with a long, conventional recording head (not shown) having a small gap, i.e. 0.001 inch. The polarity of the recording head is repeatedly altered as the recording medium moves relative to the head so as to premagnetize the medium as horizontal bands 97 of opposite polarity as shown in FIG. 6. The width of these bands being of the order of 0.002 inch, the medium so premagnetized will cause adhesion of magnetic toner over its entire surface, except at those points where premagnetization is eliminated.

In use, then, the premagnetized medium is scanned by a recording head having the conductor patterns illustrated in FIG. 5 and selected ones of the magnetically active centers 92 are activated to demagnetize opposing points on the medium. Following this, magnetic toner is applied to the medium which adheres only to the portions still magnetized. Resultantly, a visible negative image is developed on the recording drum. This can then be transferred to a suitable substrate to make reproductions of the negative image as described above. It is important to note that the centers 92 must overlap in order to allow for an all-white image. In other words, if the pole areas did not overlap, as in the FIG. 2 head, there would be segments of the drum spaced along the axis thereof which could not be demagnetized.

Our technique can also be implemented to sweep out a latent magnetic image electronically in two dimensions simultaneously. The procedure for doing this is the same as that described above in connection with FIGS. 1–3 except that the recording member is preferably flat as is the front face of the recording head. In other words, the recording member and head do not move relative to each other. The various conductor layers should lie flush against the recording medium in this case.

Figure 7:
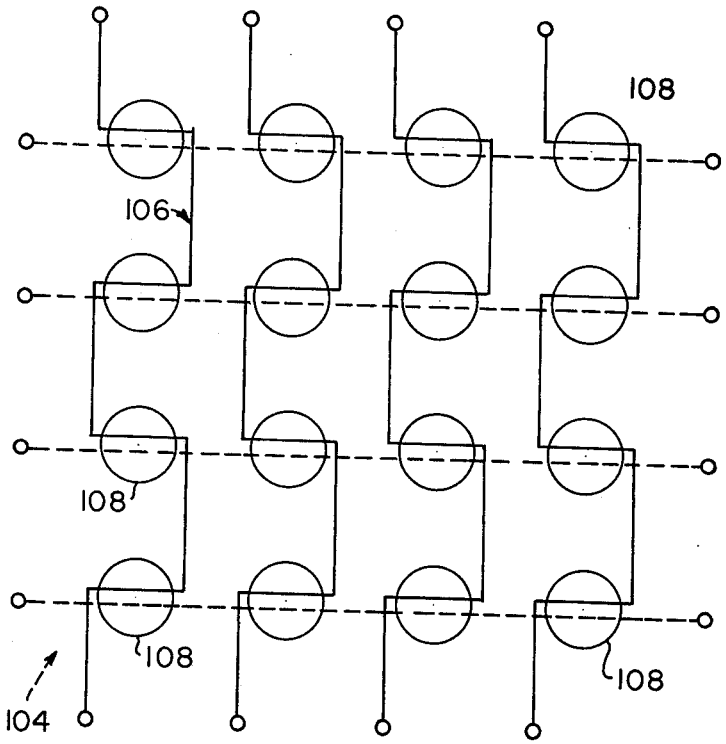
FIG. 7 is a schematic diagram of still another head embodiment.

The arrangement of the conductors for a sixteen pole, two-dimensional recording head is shown in FIG. 7. Here, again, there are two conductor layers 104 and 106, the former being shown in dotted lines, the latter in solid lines. Also, as before, there are four conductors in each layer and segments of the conductors from both layers coincide at the circular centers 108. The directional sense of conductors in layer 106 alternate as they pass through vertically adjacent magnetically active centers. Therefore, the polarity of the currents through these conductors must be altered when "scanning" this pattern in the vertical direction. The conductors of layer 104, on the other hand, require only unipolar currents.

There are various obvious modifications which can be made in the illustrated system without departing from the essence of the invention. For example, instead of premagnetizing the recording medium 10*a*, it can be demagnetized with an AC field.

Also, in some cases, it may be desirable to include pole structures made of a magnetizable material in the recording head 12 in FIG. 1 in order to obtain the proper magnetic field characteristics, particularly in the case when a biasing field is used. Also, a nonconductive magnet may be laminated between the pole pieces. These pole pieces are essentially flat and have rectangular protrusions along one edge which project out through the front of body 32 (FIG. 2). The edges of the pole pieces are grooved so as to form the protruding poles to accept the meandering conductors 34 and 36 described above. Heads so equipped with pole pieces require less current in the conductors to generate the requisite magnetic field $H_1$ and $H_2$. Preferably, the whole assembly, including the pole pieces, magnet and conductors, is encapsulated in a thermosetting material. Also, the ends of the pole pieces are lapped to assure that the head will be in close proximity to the recording medium during operation of the system.

The control system 13 which determines which magnetically active centers in the recording head are activated at any particular time is of conventional construction. A suitable system of this type is disclosed, for example, in U.S. Pat. No. 3,345,458 dated Oct. 3, 1967. That patent discloses a system for the digital storage and generation of a video signal. However, the same principles apply here. Basically, that system sweeps out a pattern line-by-line in a raster format, each line containing a part of a line of characters or part of a picture. Basically, the system is comprised of a memory for storing the character or picture information, a coding matrix for converting the stored information to a "yes" or "no" format for unblanking a standard television receiver and a timing unit for applying the stored information at the proper time in each raster scan line.

In the present system, a recording head with 2056 magnetically active centers requires 64 meandering conductors in layer 36 (FIG. 3) and 32 conductors in layer 34 running through 64 adjacent centers. Ordinarily, a total of 96 switches are required to selectively activate the various centers. However, this number can be reduced to 28 by using well-known switch-matrixing techniques. In most applications, the logic is arranged to activate the centers in the head 12 in the order of their physical arrangement in the head. Thus, for example, when impressing a typewritten page on the drum, the control system 13 includes an alterable memory and a pattern generator including a fixed memory. The alterable memory receives coded data representing a line of characters on the printed page. Then the character generator generates the dot sequences on the medium 10*a* required to form the characters in accordance with the information from the memory. That is, the character generator translates the coded data in the memory to a digital format capable of energizing different selected ones of the conductors 34 and 36 at the proper points in the scanning sequence. The technique for digital storage and generation of such signals is fully disclosed in the aforesaid U.S. patent. Suffice it to say, if no spot is required on the recording medium at a particular point in the sweep, the output of the control system 13 will not select one of the switches needed to generate the coinciding fields for that particular spot. Of course, if the system is generating negative images, the information in the memory has to be complemented.

It is also possible to our disclosed multipole recording head in ultrafast facsimile printing systems. For generating black and white facsimile prints, the decision as to whether or not a particular magnetic spot is to be made on the recording medium is received by the head from a suitable video source properly synchronized with the FIG. 1 system. Where gray tones are desirable in the print, the video source provides an amplitude modulated analog signal which indicates the desired degree of blackness in the dots at each point in the sweep. This analog signal is then used to control the strength of at least one of the coincident fields developed at a particular magnetically active center. The strength may be varied between zero and the normal value for coincident field operation as described above in connection with FIG. 4. Alternatively, the biasing magnet 45 (FIG. 2) may be an electromagnet and the video signal used to control the value of the bias field.

Modulating at least one of the magnetic fields in this fashion causes a variation in the size of the spots impressed on medium 10*a*. This is due to the fact that the magnetic field at the center of an active spot is stronger than the field at the periphery thereof. Consequently, if one or more of the coincident fields is reduced in strength, the fringes of the opposing spot on the recording medium are subjected to a weaker field than the threshold field $H_T$ of the recording medium. Consequently, the magnetization at these fringes will not be changed, with the result that the magnetic spot becomes smaller. The limiting case is where one of the coincident fields is reduced to a point where no spot at all is impressed on the medium.

Gray tone facsimile printing with our system can also be improved by modifying the shape of the conductor segments at the magnetically active centers 48 (FIG. 3). More particularly, if the conductor segments within the pole areas are pinched or restricted at the centers of the areas, the ratio of the spot field strength at its center to that at its fringe is increased. Preferably, this field strength ratio should be kept below an optimum value equal to the quotient of the coincident field $H_1$ and $H_2$ at the center of the spot, plus the threshold field for the particular medium 10*a* divided by the same threshold field.

It will be seen from the foregoing then that the combination of our coincident field selection with a control system incorporating matrix switching results in a drastic reduction in the number of electronic components required in order to make a very large mutlipole magnetic printing system capable of operating at very high speeds. Further, it should be understood that the conductor meander patterns in the head specifically illustrated herein are only exemplary and that many variations of these patterns are possible to produce the same or comparable results.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interepreted as illustrative and not in a limiting sense.

It is also to be understood that the following claims are intended to cover all of the generic and specific features of the invention herein described.

We claim:

1. A system for generating closely spaced magnetic images comprising

A. a recording medium,

B. a recording head positioned opposite the medium, said head including at least two distinct vertically juxtaposed layers of different electrical conductors, there being at least two conductors in each layer, said conductors in each layer having segments which are in close proximity with, substantially parallel to and vertically superimposed on segments of conductors in the other layers to form at least four magnetically active centers with each such center being defined by two or more parallel superimposed conductors, one conductor from each layer, and C. means for selectively passing electrical currents simultaneously through all of the conductors defining a magnetically active center so as to generate coinciding magnetic fields at that selected magnetically active center which are additive so that together they are sufficiently strong to change the direction of magnetization is a selected small area of the recording medium.

2. The system defined in claim 1 wherein

A. said parallel conductor segments are aligned in a first direction, and

B. the conductor lengths on each side of said parallel segments are aligned generally perpendicular to said first direction.

3. The system defined in claim 2 wherein the recording medium comprises

A. a support member, and

B. magnetic crystals affixed to the support member so that their easy axes of magnetization are oriented perpendicular to said first direction.

4. The system defined in claim 1 and further including a magnet

A. mounted on the head, and

B. being arranged to provide a magnetic field to reinforce the magnetic fields produced at said magnetically active centers.

5. The system defined in claim 1 and further including

A. means for applying a finely divided magnetic developer susbstance to the recording medium which tends to adhere to portions of the magnetized recording medium so as to produce a visible image on the medium, and B. wherein the magnetic fields from the selected small areas are of sufficient strength to adhere the magnetic developer substance to those areas.

6. The system defined in claim 1 wherein the current passing means comprise A. a current source, and B. switch means for connecting said selected conductors to the current source at selected time intervals.

7. The system defined in claim 1 wherein the conductor layers are sandwiched together on the face of the recording head opposite the recording medium so that the magnetically active centers are spaced along a relatively straight line on that face.

8. The system defined in claim 1 wherein each conductor layer includes

A. an insulating substrate, and

B. a multiplicity of meandering conductors affixed to the substrate.

9. The system defined in claim 1 and further including a thin, nonconductive film overlying the conductor layers so as to protect the outermost layer from abrasion from the recording medium.

10. The system defined in claim 1 wherein the layers are sandwiched together on the face of the recording head opposite the recording medium so that the magnetically active centers are spaced in a two-dimensional array on that face.

11. The system defined in claim 1 wherein said segments from each layer that are in close proximity are arranged to form magnetically active centers which overlap.

12. The system defined in claim 1 wherein the recording medium is premagnetized in such a manner as to attract finely divided magnetic developer substance over the premagnetized portion of the medium.

13. The system defined in claim 1 and further including means responsive to an input signal for controlling the current flowing through at least one of the conductors at each magnetically active center so as to control the sizes of areas on the recording medium whose magnetization is changed by the head.

* * * * *